United States Patent [19]

Polson

[11] 4,336,734

[45] Jun. 29, 1982

[54] DIGITAL HIGH SPEED GUITAR SYNTHESIZER

[76] Inventor: Robert D. Polson, 1140 S. 500 East, Apt. #2, Salt Lake City, Utah 84105

[21] Appl. No.: 157,423

[22] Filed: Jun. 9, 1980

[51] Int. Cl.[3] ..... G10H 1/00

[52] U.S. Cl. ..... 84/1.01; 84/DIG. 30; 84/1.16

[58] Field of Search ..... 84/1.01, 1.24, 1.16, 84/DIG. 30; 307/116; 340/365 A, 365 C

[56] References Cited

U.S. PATENT DOCUMENTS 3,805,086 4/1974 Larson et al. ..... 307/116

4,177,705 12/1979 Evangelista ..... 84/1.16

*Primary Examiner*—J. V. Truhe

*Assistant Examiner*—Forester W. Isen

*Attorney, Agent, or Firm*—Trask & Britt

[57] ABSTRACT

A musical instrument is structured as a guitar and incorporates electronic circuitry to synthesize musical tones. The instrument is played in the fashion of a guitar with tones generated in response to switches activated through strumming action. The pitch of the tones is controlled by touch-sensitive switch devices mounted at addresses corresponding to fret and string locations. The instrument may be polyphonic with separate tones generated by activation of a plurality of devices corresponding to strings.

16 Claims, 29 Drawing Figures

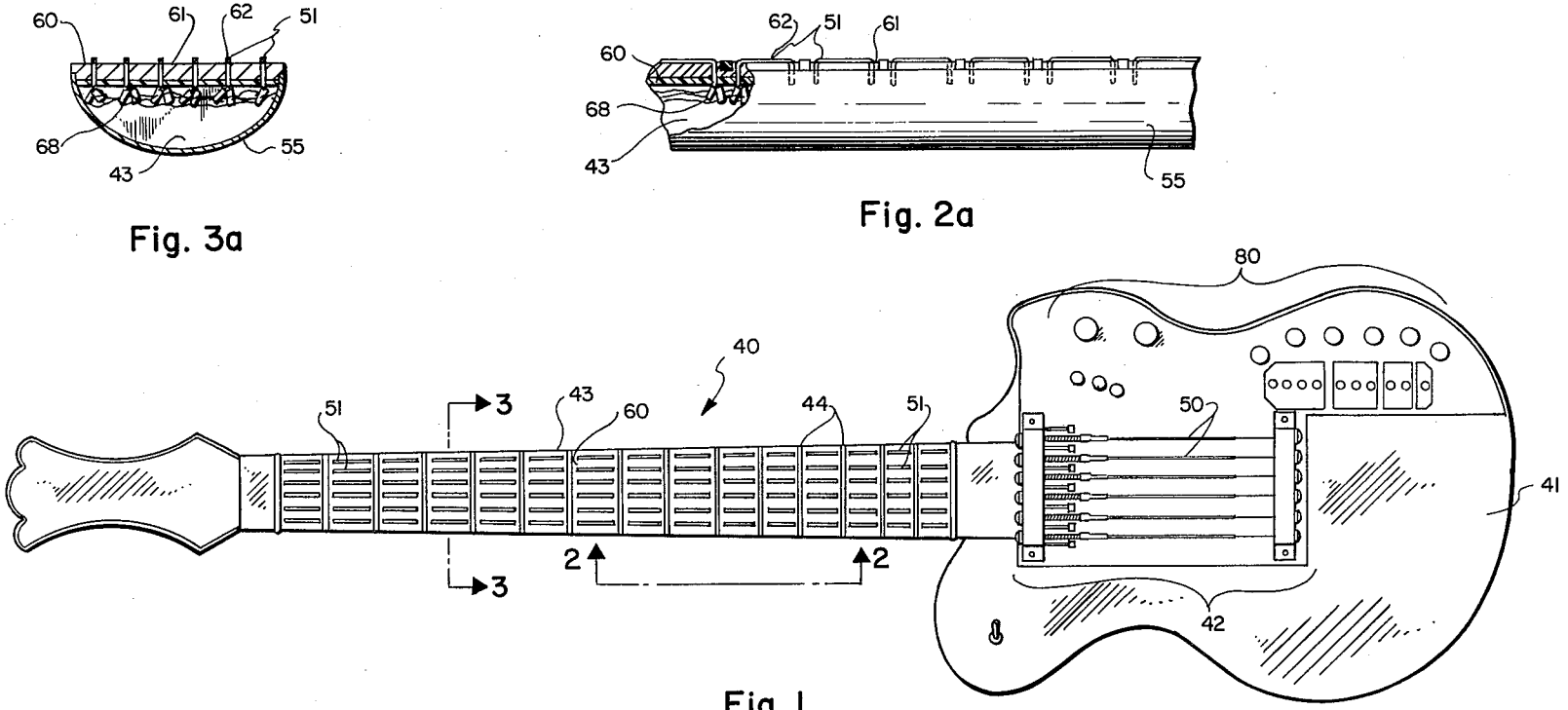
Fig. 1
Fig. 2a
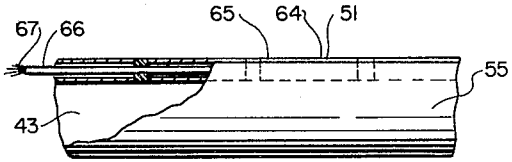
Fig. 2b
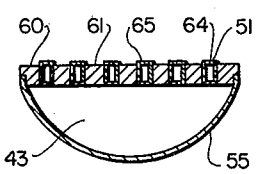
Fig. 3b
Fig. 3a
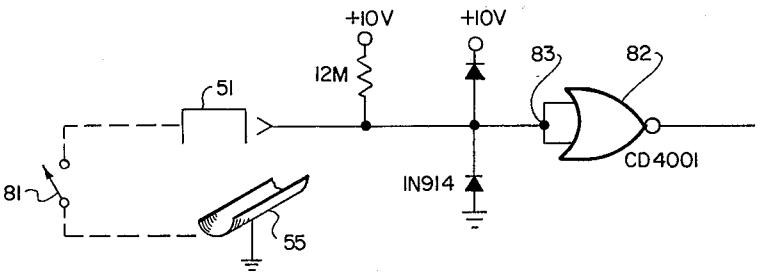
Fig. 4a

| INPUTS | | OUTPUTS | |
|---|---|---|---|
| 1 | 2 | 4001 | 4071 |
| 0 | 0 | 1 | 0 |
| 0 | 1 | 0 | 1 |
| 1 | 0 | 0 | 1 |
| 1 | 1 | 0 | 1 |

DIGITAL HIGH SPEED GUITAR SYNTHESIZER

BACKGROUND OF THE INVENTION

Field

This invention relates to musical instruments and specifically to electronic instruments which synthesize musical tones. It provides such an instrument which may be embodied either as a monophonic device or as a polyphonic device capable of synthesizing chords, after the fashion of a guitar.

State of the Art

Guitars have been popular musical instruments for centuries. In a guitar, tones are generated by plucking or strumming one or more strings. The tones thus produced include a number of harmonics which are selectively amplified by the sound box of the instrument. In recent decades, electronic pickups have been incorporated in certain guitars and associated electronic circuitry has been employed to select, amplify and/or modify the tones generated by the guitar strings. In many modern electric guitars, the sound box has been replaced by a solid structural member because the treatment of the tones generated by the string is entirely electronic. The guitar has long been recognized as an extremely versatile instrument in that it is capable of playing chords and melody lines. Moreover, it is by virtue of its configuration and the technique of playing the instrument, a relatively simple instrument to learn. In addition, the fashion in which a guitar is customarily held by a player lends a degree of personal intimacy between the instrument and the performer which cannot be duplicated, and is normally not associated with keyboard instruments.

Electronic musical synthesizers of various types are also well known. Although such instruments are widely used in recording studios and for certain types of concert effects, they are severely limited and do not lend themselves well to virtuoso solo performances. Such instruments are interesting and useful because tones are generated entirely electronically, and they do not rely upon a vibrating string for this purpose. Aesthetically, however, they lack the warmth of traditional instruments such as guitars. Moreover, as presently available, they are monophonic or at most diaphonic, and are thus not capable of producing chords. The only practical way to produce polyphonic music with such instruments is to either use a plurality of them or to record monophonic lines in sequence on several tracks in a studio, and to thereafter blend the tracks into a polyphonic summation.

A number of United States patents disclose electronically operated stringed instruments. For example, U.S. Pat. No. 3,465,086 (Borell) and 3,709,084 (stobough) are typical of patents disclosing electronic circuits for either amplification or tone generation. U.S. Pat. No. 2,792,738 (Donahue) discloses a guitar in which tones are produced by depressing rather than plucking the strings. U.S. Pat. No. 3,555,166 (Gasser) discloses an electronic guitar having keys located on its neck which, when depressed, actuate switches. The body of the guitar includes an accordion-type keyboard, the keys of which also actuate switches. U.S. Pat. No. 3,666,875 (Ranzato) discloses an electronically operated device for simulating stringed instruments. The tones of this device are generated upon release of switches or buttons on the body of the guitar. U.S. Pat. No. 3,662,641 (Allen) discloses the use of touch sensitive switches located on the neck of a guitar. Tones are generated by plucking a special type of short string. None of the aforementioned patents discloses an instrument which can be played in the fashion of a guitar, that is, by supporting the neck of the guitar in the palm of the hand while moving between fret and string locations to quickly produce tones of the desired pitch. Moreover, none of these patents disclose an instrument which is capable of producing electronically generated chords.

SUMMARY OF THE INVENTION

The present invention provides a musical instrument having the appearance and characteristics of a guitar; that is, it is held and played in the fashion of a guitar so that one familiar with the technique of playing an electric guitar can readily adapt to the instrument of this invention. However, the sound generated by the instrument is produced entirely electronically. The sounds are generated through techniques similar to those currently employed to produce electronically synthesized sounds, but the instrument processes the sounds in novel ways to produce a variety of interesting musical effects.

The invention can be embodied variously as either a monophonic instrument or a polyphonic instrument. In either case it can be provided with a wide range of capabilities, and can produce sounds and effects analogous to those available with acoustic and electric guitars. Additional unique effects and tones may be incorporated in the instrument of this invention if desired. As typically embodied, the invention comprises four basic functional elements, namely, a touch arm apparatus, a strum simulation apparatus, means for envelope generation (volume or loudness), and means for harmonic generation (both static and time variable).

An important aspect of the present invention is the configuration of the guitar arm; i.e., the touch arm apparatus. The arm includes structures corresponding to conventional frets. These frets or segments of these frets comprise one contact of a touch-sensitive switch. The other contact of each such switch is connected to a conductive strip positioned along the arm for continuous contact by the palm of a player's hand, when the guitar is held in a conventional fashion. The fret contacts are located at "addresses" which correspond to the intersection points of strings and frets on a traditional guitar. Each address may thus be identified by a "file" or string designation and a "rank" or fret designation.

Preferably, the touch switches are of common design and are constructed from high impedance (complimentary metal oxide semiconductor CMOS) devices. According to some forms of the invention, the back of the instrument is constructed of a lightweight metal electrically connected to a voltage potential so that it is coupled through the user's hand with the frets. The hand acts as a high impedance resistor between the guitar arm and the frets. The fret board portion of the instrument may also include charged sections to increase touch switching sensitivity. Of course, care should be taken in the construction of such embodiments to avoid the hazards of electrical shock (although this possibility is very minimal considering the low current of CMOS devices). Nevertheless, instruments of this type will find application in the controlled environment of a recording studio. Preferably, a unique gating system is associated with the touch switches to sense when two or more switches in the same string file are activated. The gating system functions such that only the pressed fret position (rank) closest to the body of the guitar selects a tone from the tones available for that string. This feature assures that tone selection for any string is entirely analogous to that experienced with a conventional guitar.

The strum area of the guitar of this invention is also unique. It comprises switch mechanisms which are configurated for actuation as though they were strings, that is, a plucking, strumming or tapping action will suffice to bring individual strum switches into operation. Generally, a plurality of conductive members (such as wires or bars) are mounted across the strum area to simulate strings corresponding in number and location to the strings which would be present in a conventional bass or lead guitar. These switches may also be touch-sensitive or they may be mechanically adapted for operation through the physical touching of contact elements. In any event, actuation of a strum switch generates a tone which is associated with all of the fret locations (addresses) intersected by an imaginary string associated with that strum switch. The pitch of the tone generated by activation of any strum which is determined by activating any of the fret switches associated with that strum switch just as in the case of an ordinary guitar.

BRIEF DESCRIPTION OF THE DRAWINGS

In the drawings, which illustrate that which is presently regarded as the best mode for carrying out the invention:

FIG. 1 is a plan view of a guitar instrument of this invention, showing its face or playing surface;

FIGS. 2*a* and 2*b* are fragmentary views, partially in section, showing a portion of the arm of the guitar of FIG. 1 designated by the reference line 2—2 of FIG. 1 and illustrating alternative fret constructions;

FIGS. 3*a* and 3*b* are alternative cross-sectional views taken along the reference line 3—3 of FIG. 1 illustrating the fret constructions of FIGS. 2*a* and 2*b*, respectively, rotated 90°;

FIG. 4*a* is an electronic diagram illustrating the circuit components of a touch-sensitive switch device of this invention;

DESCRIPTION OF THE ILLUSTRATED EMBODIMENTS

Figure 8:
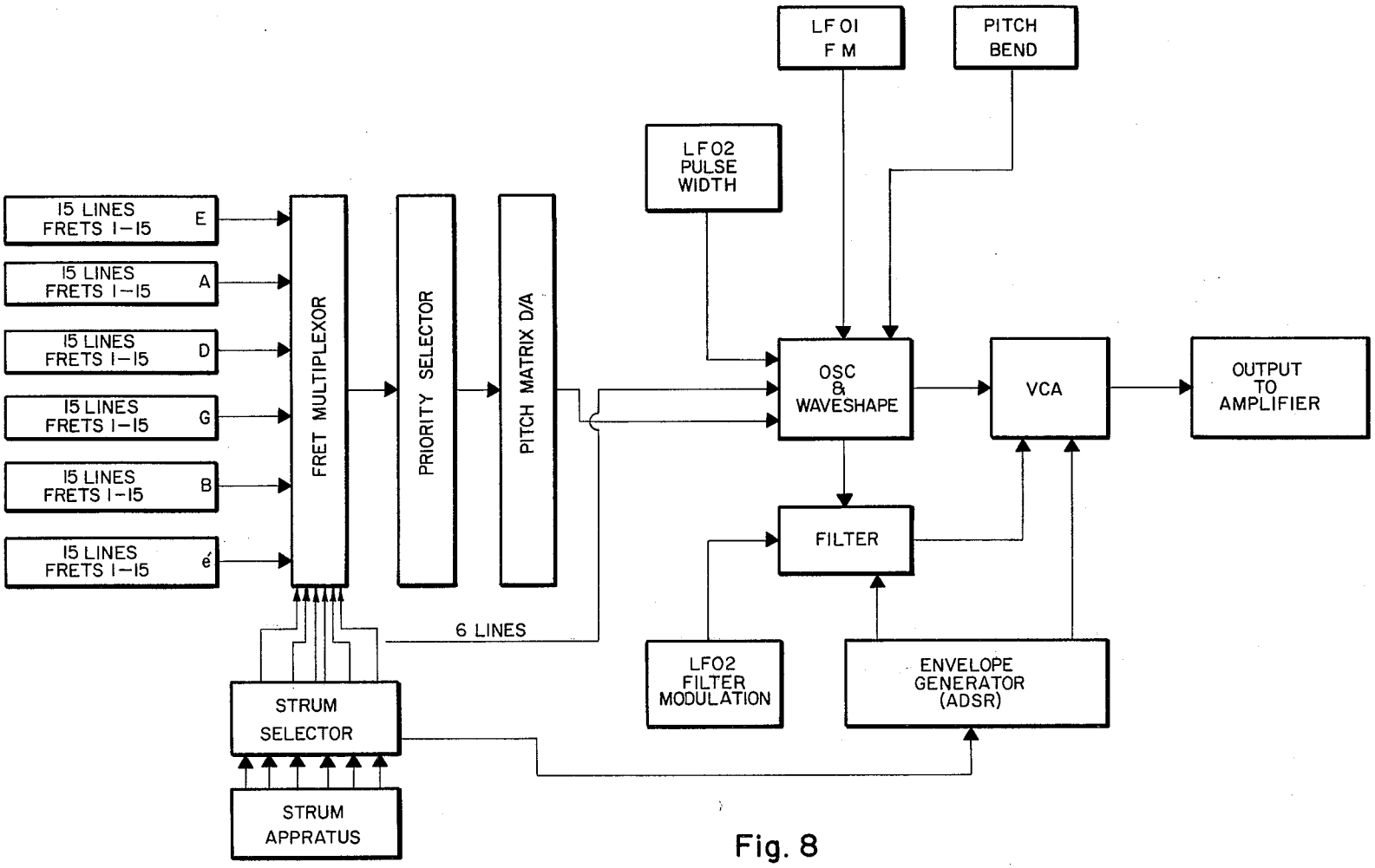
FIG. 8 is a block diagram illustrating the basic circuit functions and organization of a monophonic system embodying the invention.
Figure 9:
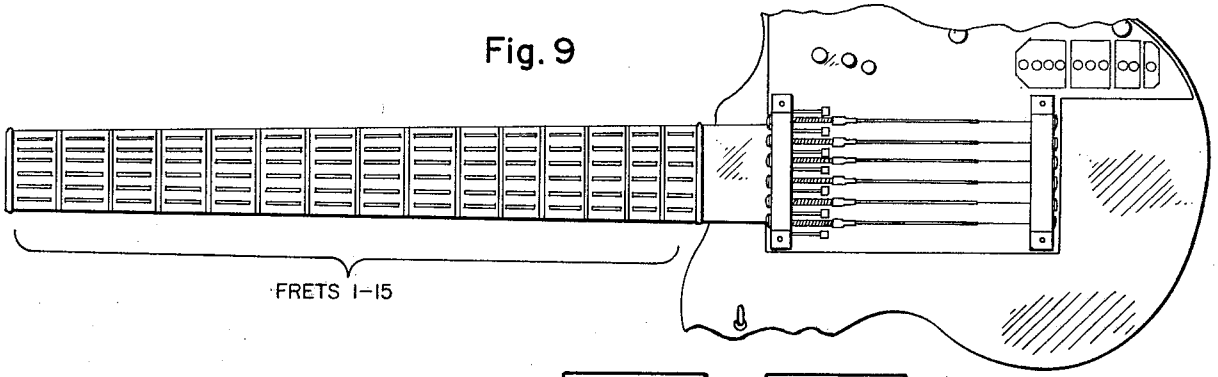
FIG. 9 is a fragmentary view of a portion of the instrument illustrated by FIG. 1.
Figure 10:
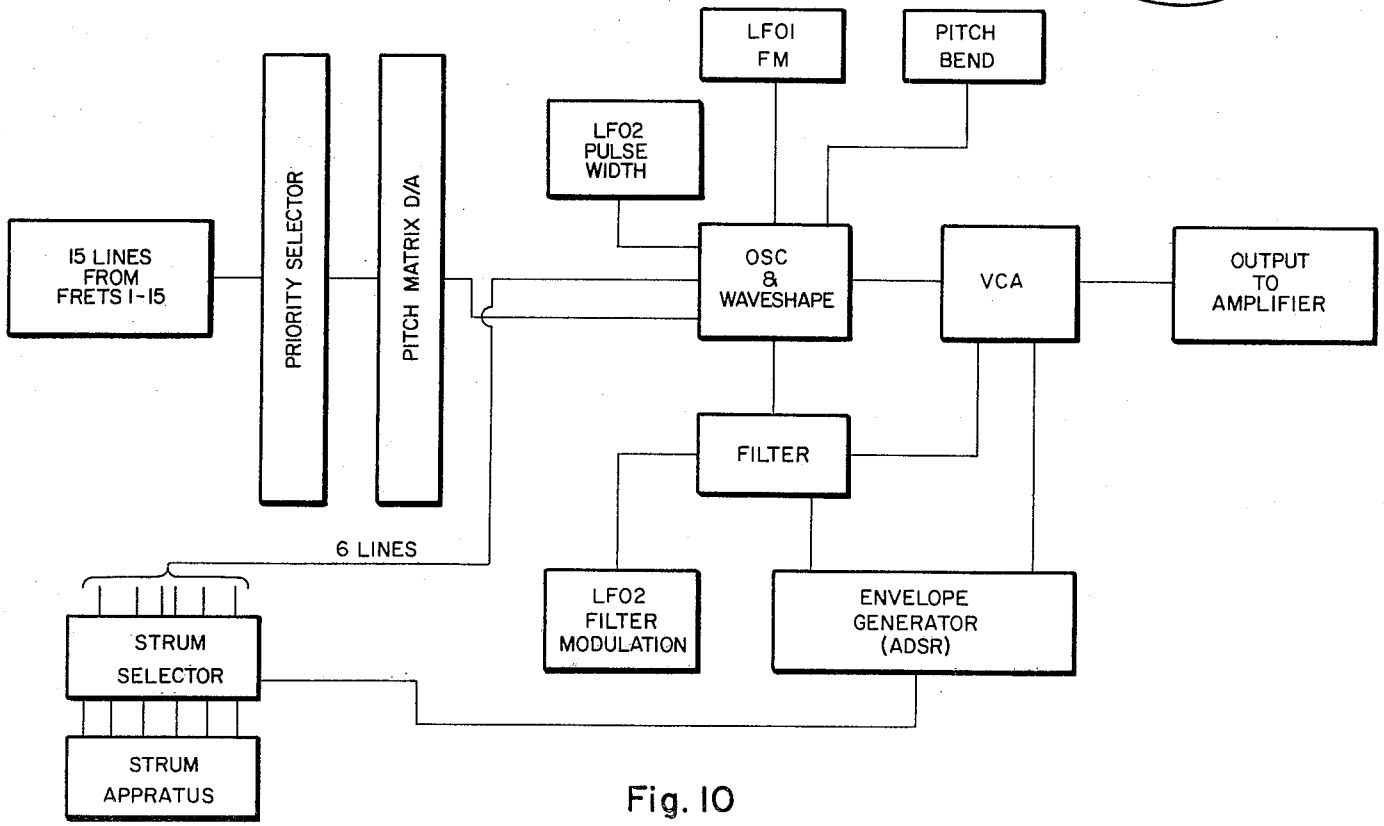
FIG. 10 is an electronic block diagram similar to FIG. 8 illustrating an alternative monophonic system embodying the invention.
Figure 11:
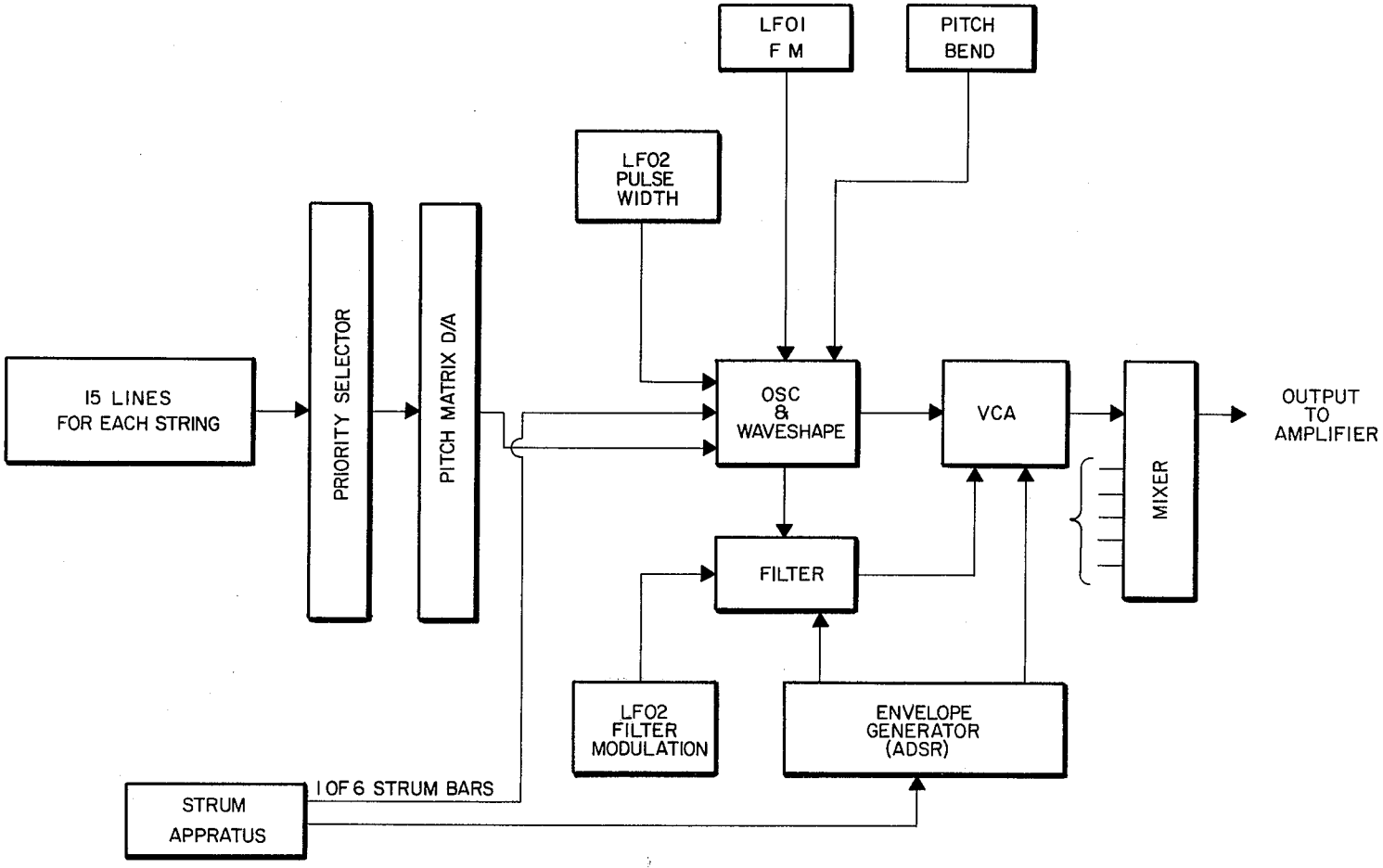
FIG. 11 is a block diagram showing the circuit configuration and components for a polyphonic system embodying the invention.
Figure 12:
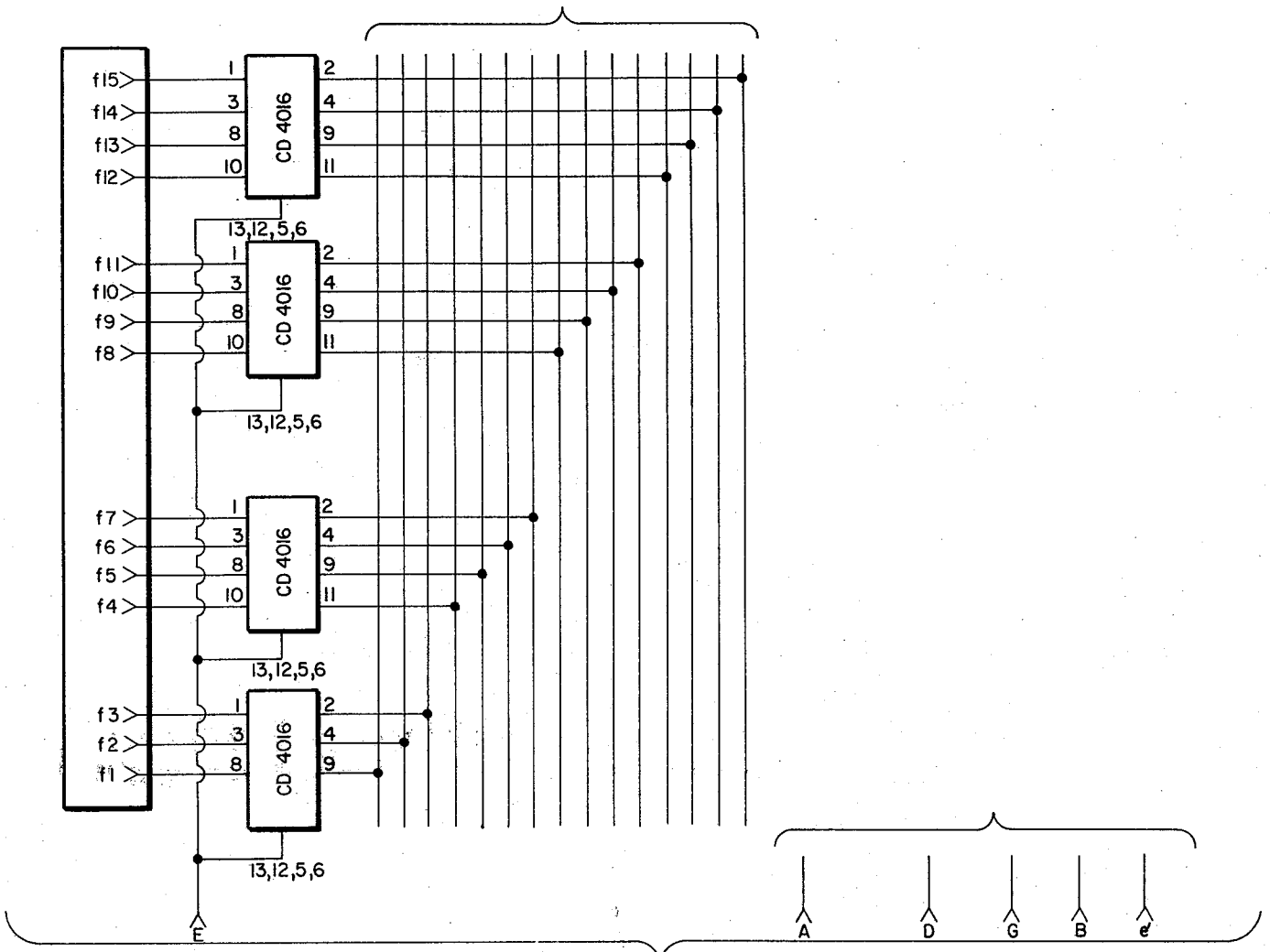
FIG. 12 is a partial diagram illustrating a fret selection multiplexer useful in connection with the monophonic embodiment illustrated by FIG. 8.
Figures 13, 14:
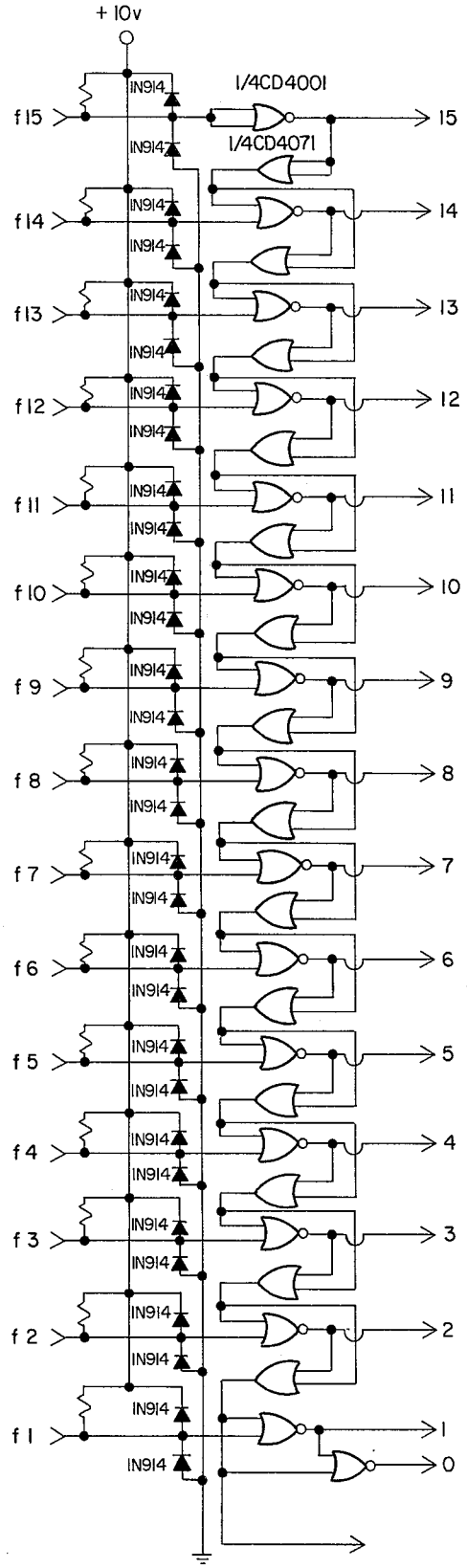
FIG. 13 is a schematic circuit diagram illustrating the components of a priority selector useful with both monophonic and polyphonic embodiments of the invention.
FIG. 14 is a logic table illustrating the output condition resulting from the input condition of the gates of FIG. 13.
Figure 15:
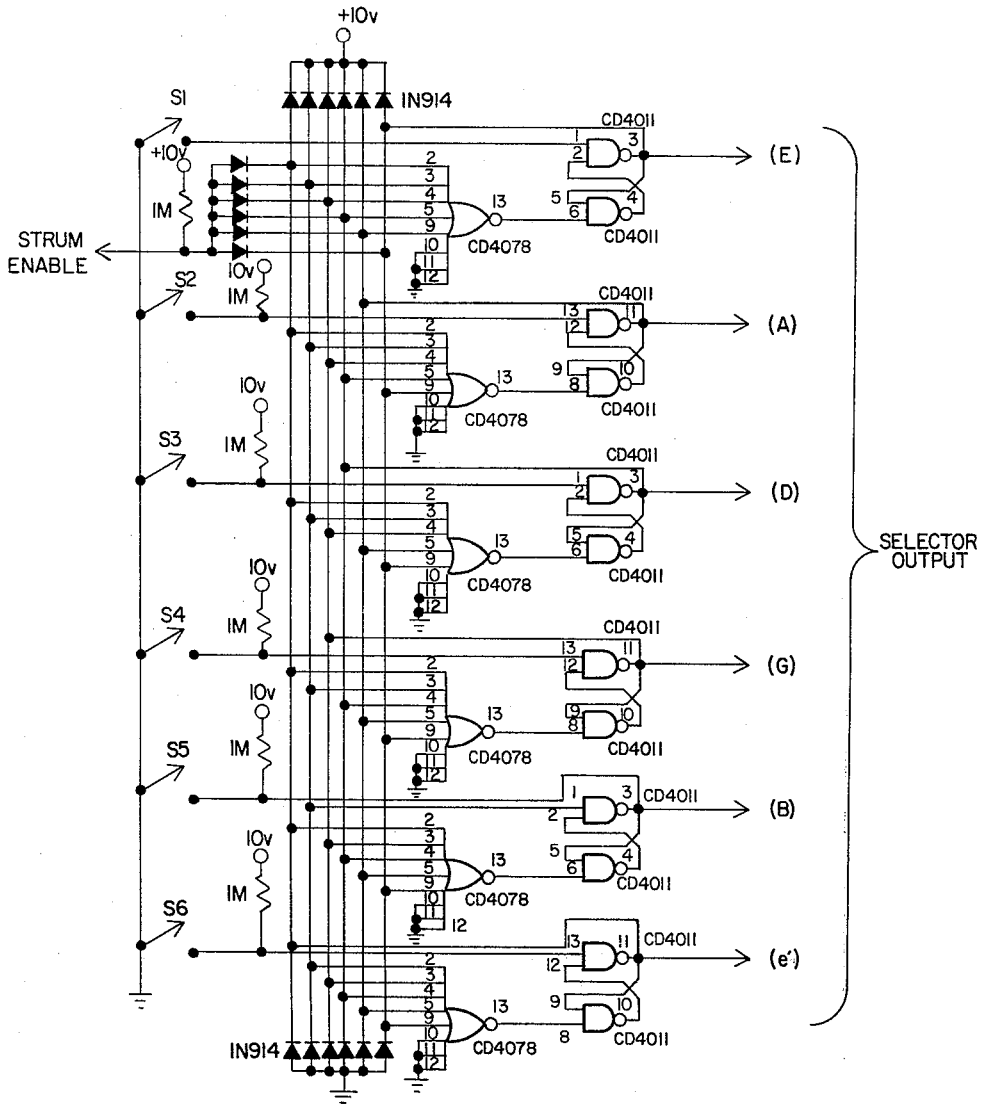
FIG. 15 is a schematic diagram illustrating the components of a string selector circuit useful in connection with monophonic embodiments of the invention.
Figure 16:
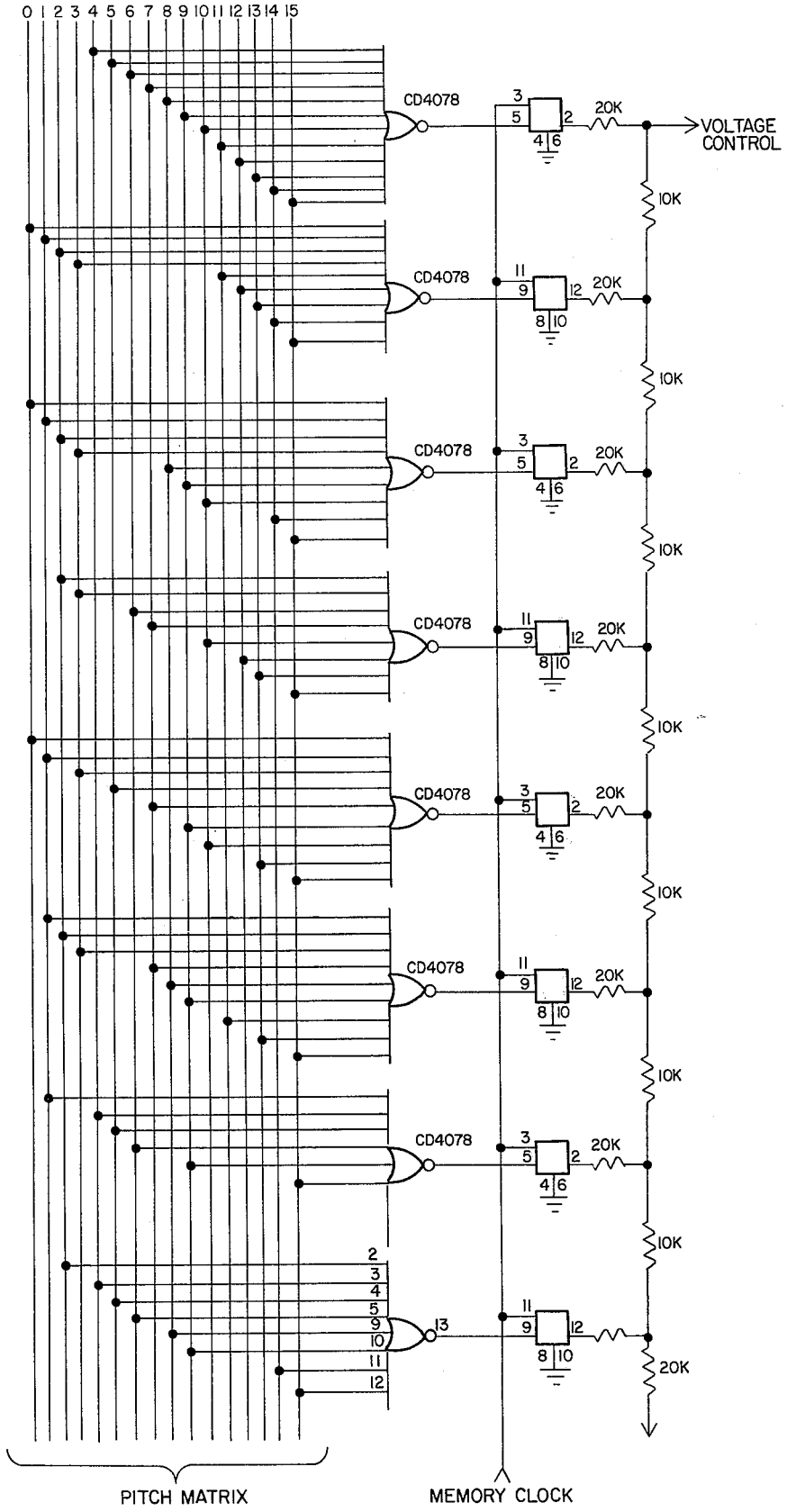
FIG. 16 is a schematic diagram illustrating the circuit components of a pitch matrix digital to analog circuit of the invention.

The drawings illustrate three distinct embodiments of the invention; namely, two monophonic systems (shown schematically by FIGS. 8 and 10, respectively) and a polyphonic system (shown schematically by FIG. 11). These and other embodiments of the invention will be selected depending upon the performance mode intended for the instrument, among other factors. In any event, FIG. 1 illustrates an arrangement of parts, designated generally 40, with which any of the illustrated embodiments may be incorporated. The instrument 40 is structured in a format similar to a standard electric guitar with a body 41 supporting a strum region 42 and connected to an arm 43 divided by a plurality, typically 15, of frets 44.

In the illustrated instance, the strum region 42 includes a number of strum bars 50 corresponding in placement to the six strings normally found in a six string guitar. It should be understood that embodiments are within contemplation which rely upon a single strumming apparatus 50 or a plurality other than the six illustrated. A plurality of touch-sensitive devices 51 is arranged in a grid of addresses corresponding to the intersection regions of a plurality of ranks of fret locations and files of string locations such that each address (location of a device 51) corresponds to the intersection of a string with a fret by analogy to a conventional guitar. As illustrated, the string locations are extensions of the strum bars 50 up the arm 43 of the instrument. Embodiments are within contemplation in which all of the devices 51 associated with a particular fret 44 are either conductively connected or replaced by a single conductive plate.

As best seen from FIGS. 2 and 3, a conductive strip 55 is carried by the arm 43 arranged for contact with the palm of a hand of an individual holding the arm in the fashion characteristic of a guitar player intending to press strings against selected frets. In the illustrated instance, the conductive element 55 comprises the entire back surface of the arm 43. The touch-sensitive devices 51 are electrically isolated from the conductive element 55 by insulating material 60 which comprises the major portion of the face 61 of the arm 43. The embodiment 62 of the devices 51 illustrated by FIGS. 2*a* and 3*a* comprises conductive loops which rise above the surface 61 of the arm 43. The embodiment 64 of the devices 51 illustrated by FIGS. 3*a* and 3*b* comprises metallic elements 65 mounted with their upper surfaces approximately flush with the insulating material 60. A cable 66 of individual strands 67 of wires is run in association with the metal elements 65 as best shown by FIG. 2*b*. Referring to FIGS. 2*a* and 3*a*, electronic components 68 may be housed within the arm 43, and the interior of the arm 43 may serve as a conduit for wiring as shown. A section of the top surface of the guitar body, designated generally 80, is devoted to various circuit controls as will be explained in more detail hereinafter.

Figure 4B:
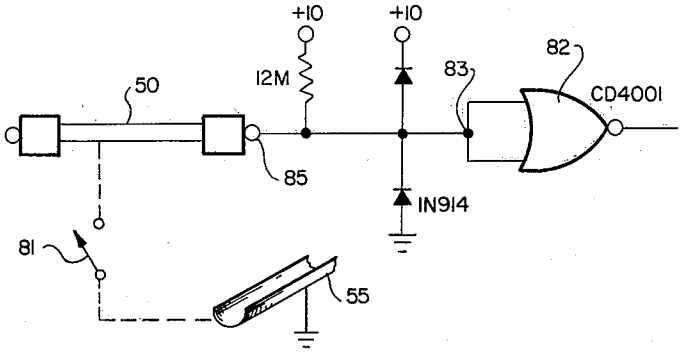
FIG. 4*b* is a diagram similar to FIG. 4*a* illustrating a similar touch-sensitive switch adapted for the strum area of the instrument of FIG. 1.
Figure 4C:
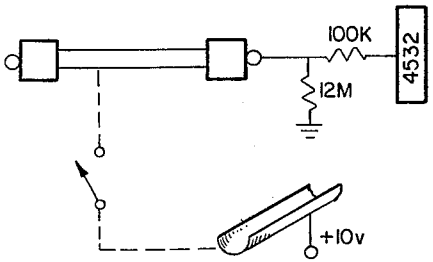
FIG. 4*c* is an electronic diagram illustrating an alternative circuit for use in place of those illustrated by FIGS. 4*a* and 4*b;*

FIGS. 4 illustrate typical touch switches constructed from high impedance CMOS gates 82. FIG. 4*a* illustrates such a switch adapted to the fret board 60, wherein the switch 81 incorporates the metallic element 55 as one contact and the touch-responsive device 51 as its other contact. In practice, these contacts are closed by simultaneous contact with the hand of an individual. As illustrated, bringing the input 83 of the gate 82 to low (usually ground) potential triggers the circuit. FIG. 4*b* illustrates a substantially identical trigger circuit adapted to incorporate a strum bar 50 rather than the device 51 as one of the contacts of the switch 81. While some form of a touch-responsive switch such as illustrated by FIG. 4*a* is an important feature of this invention, the corresponding switch illustrated by FIG. 4*b* is regarded as optional. The presently preferred embodiments of the invention substitute a mechanical switch mechanism for the touch-responsive circuit illustrated.

Figure 7:
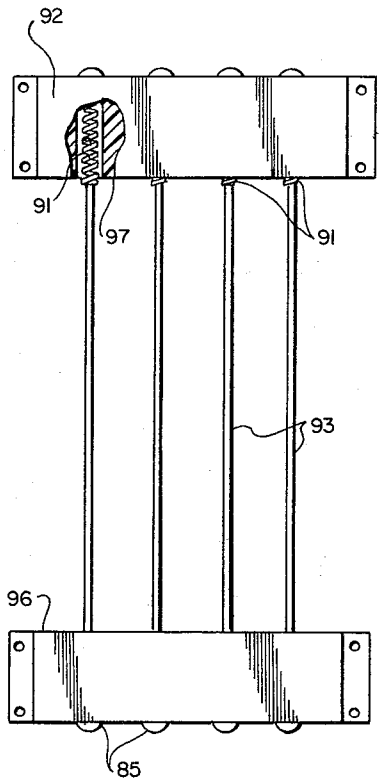
FIG. 7 illustrates an alternative construction of the strum area which relies upon direct physical grounding contact rather than touch-sensitive switching.
Figure 5:
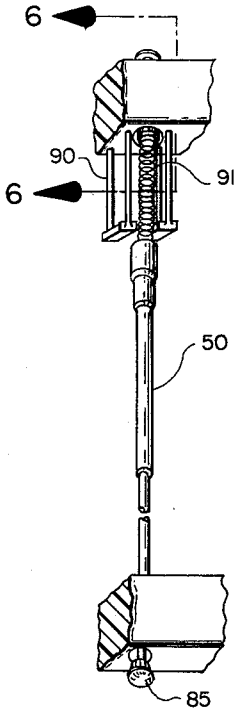
FIG. 5 illustrates a strum bar portion of the strum area and shows a mechanical equivalent of the touch-sensitive circuit illustrated by FIG. 4*b;*
Figure 6:
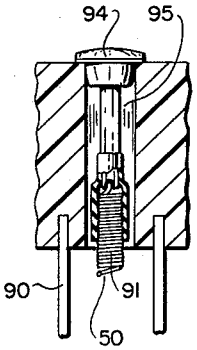
FIG. 6 is a fragmentary view in cross-section taken along the reference line 6—6 of FIG. 6.

FIGS. 5 and 6 illustrate one embodiment of such a mechanical strumming switch and FIG. 7 illustrates a highly preferred alternative embodiment of such a mechanical strumming switch. The manner in which the mechanical devices may be substituted for the touch-responsive devices into the circuit illustrated by FIG. 4*b* will be apparent by noting the locations of the signal output 85 in FIGS. 4*b*, 5 and 7, respectively. FIG. 6 illustrates one manner in which a strum device 50 may be electrically isolated from grounded structure 90 until a spring 91 is moved by finger pressure to bring some portion of the device 50 into contact with the grounded structure 90. A similar arrangement is shown by FIG. 7 in which the block 92 is at ground potential, and individual strumming elements 93 are anchored at one end 94 through bores 95 as shown by FIG. 6 in electrical isolation. Individual conductors (springs 91) are thus suspended through a conductor held at reference potential. The opposite ends of the strings 93 are anchored to an insulator block 96 as shown by FIG. 7 with individual outputs 85 similarly electrically isolated. A notable advantage of the structure illustrated by FIG. 7 is that the output 85 is brought to reference potential by contact of the spring 91 with any portion of the perimeter of the bore 97. Accordingly, a player need not be particularly concerned with the direction he moves his fingers in strumming the instrument. In this respect, the claimed instrument may be less demanding than a conventional guitar.

FIG. 11 illustrates the circuitry associated with each strum switch in a polyphonic system. Thus, each strum switch is connected in circuit with its own tone-generating means so that a plurality of tones may be generated simultaneously by operation of a corresponding plurality of strum switches. As shown, the VCA outputs generated by the several strum switches are fed through a mixer to an amplifier.

The remaining figures are self-explanatory and disclose practical circuits which are associated with the novel touch-sensitive arm structures and strum structures described. These circuits may be controlled in part by knobs and switches within the area 80 of the top face of the instrument (FIG. 1) devoted to controls or by auxiliary foot pedals or control panels. In any event, they are operable to control such effects as pitch bend, resonance, cutoff frequency, volume, attack, decay, sustain vibrato, wave forms, and frequency. Effects associated with a conventional electric guitar; i.e., "bend," "hammer," "pull off," "slide" and "mute" (or release) are readily duplicated with the circuits illustrated. In addition, the illustrated circuits can provide for "infinite sustain," an effect not associated with conventional guitars.

Figure 17:
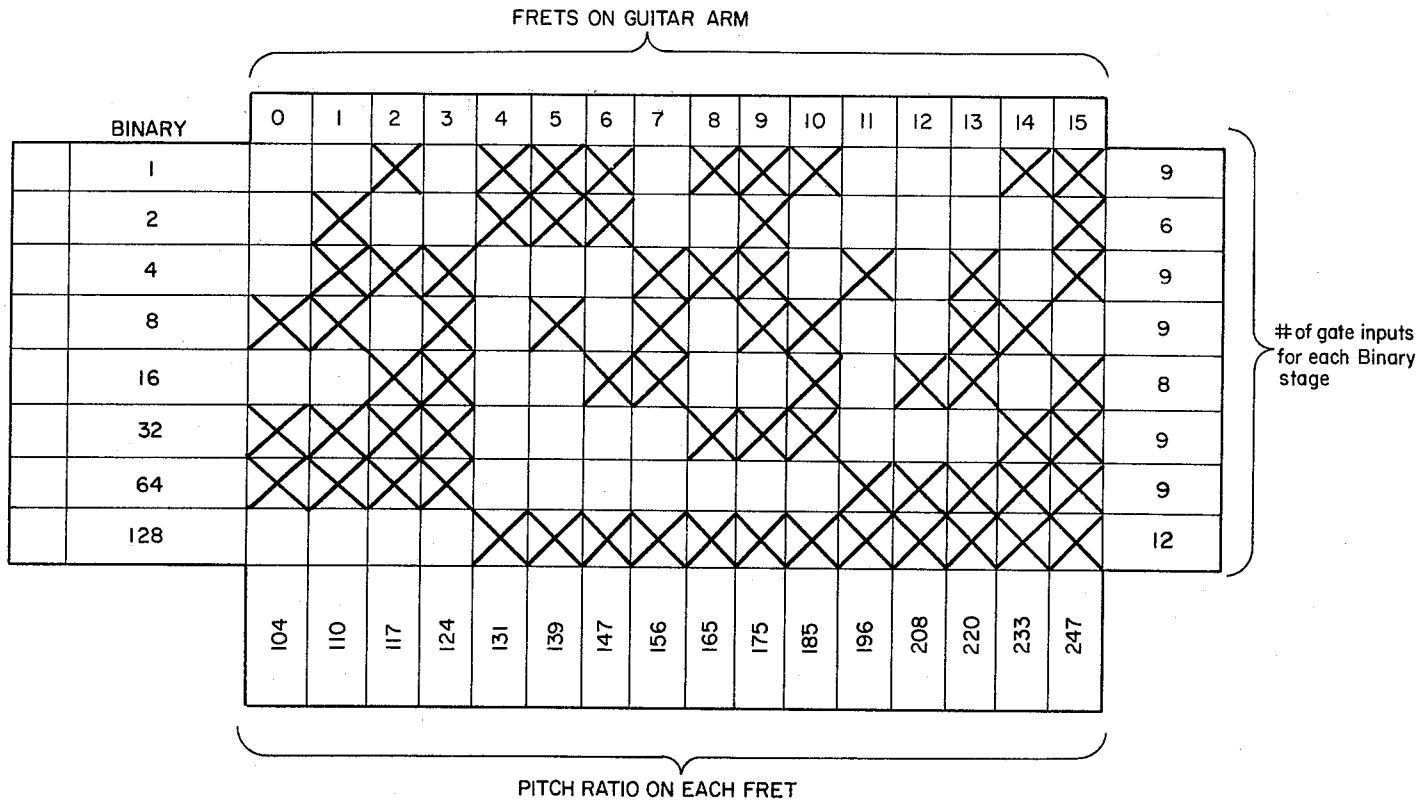
FIG. 17 is a frequency matrix table illustrating the pitch ratio resulting from the various fret locations of the guitar arm of FIG. 1.
Figure 18:
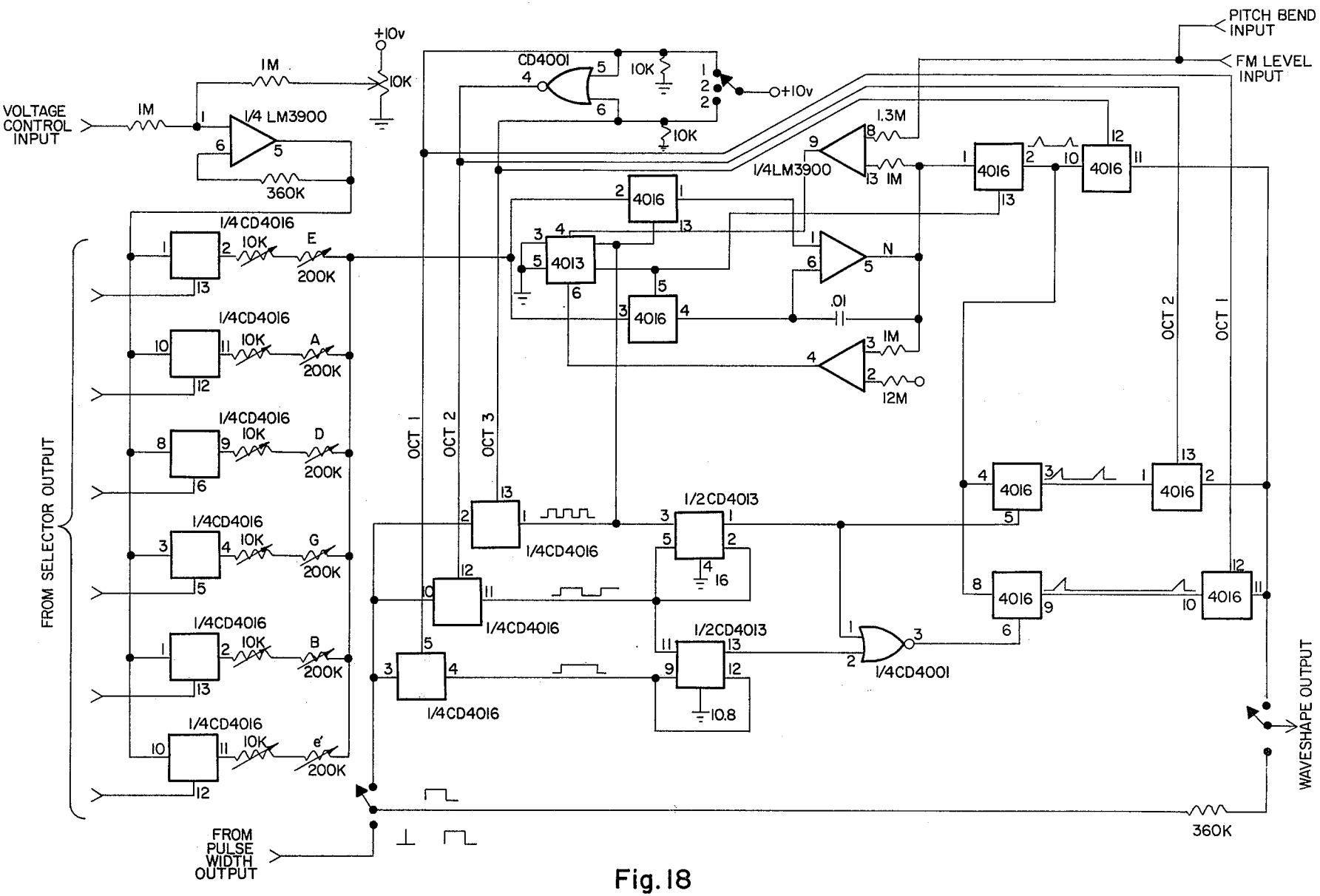
FIG. 18 is a schematic circuit diagram illustrating the components of an oscillator and wave shape selection circuit of the invention.
Figure 19:
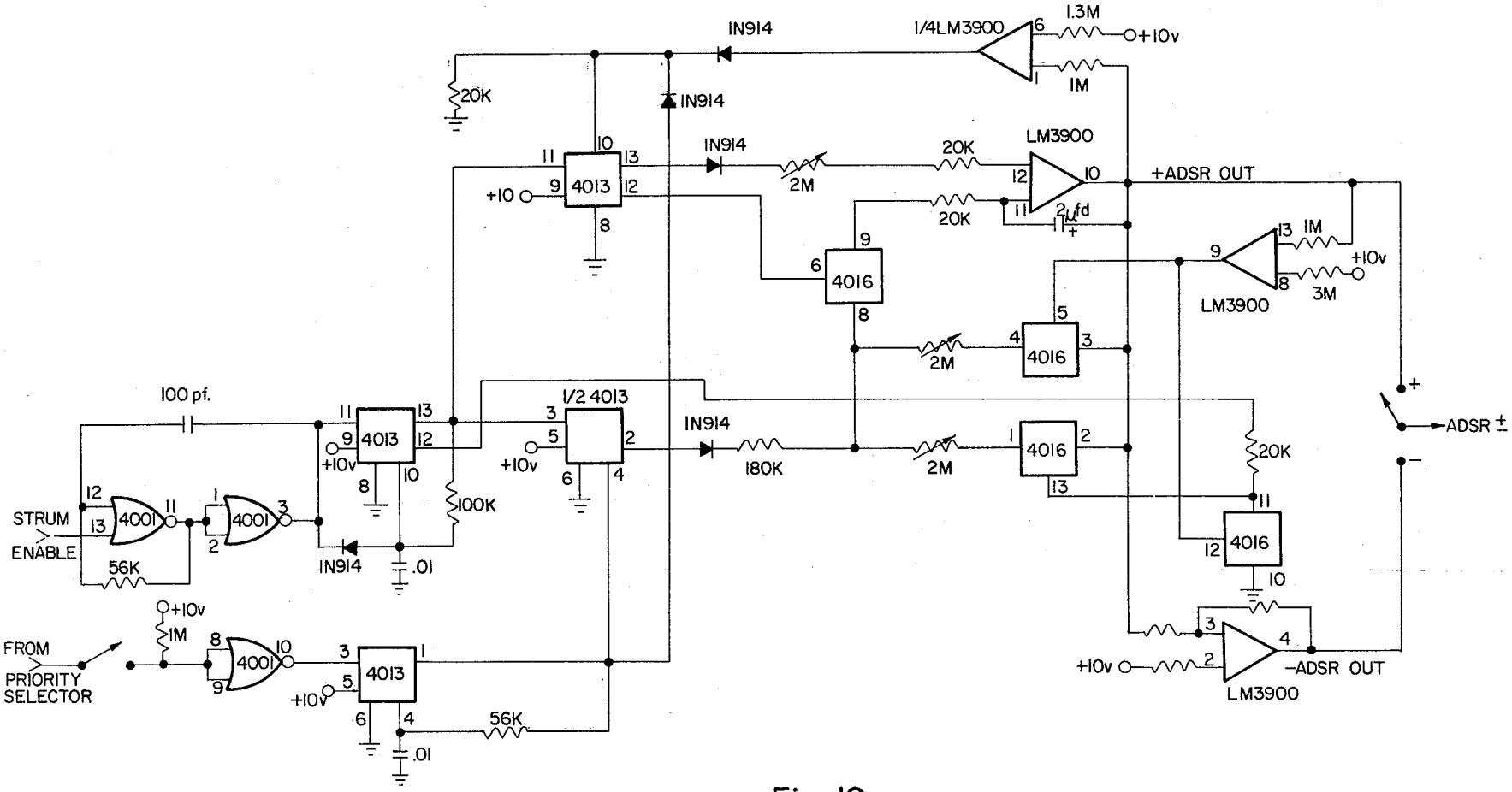
FIG. 19 is a schematic circuit diagram illustrating the components of an envelope generator circuit of the invention.
Figure 20:
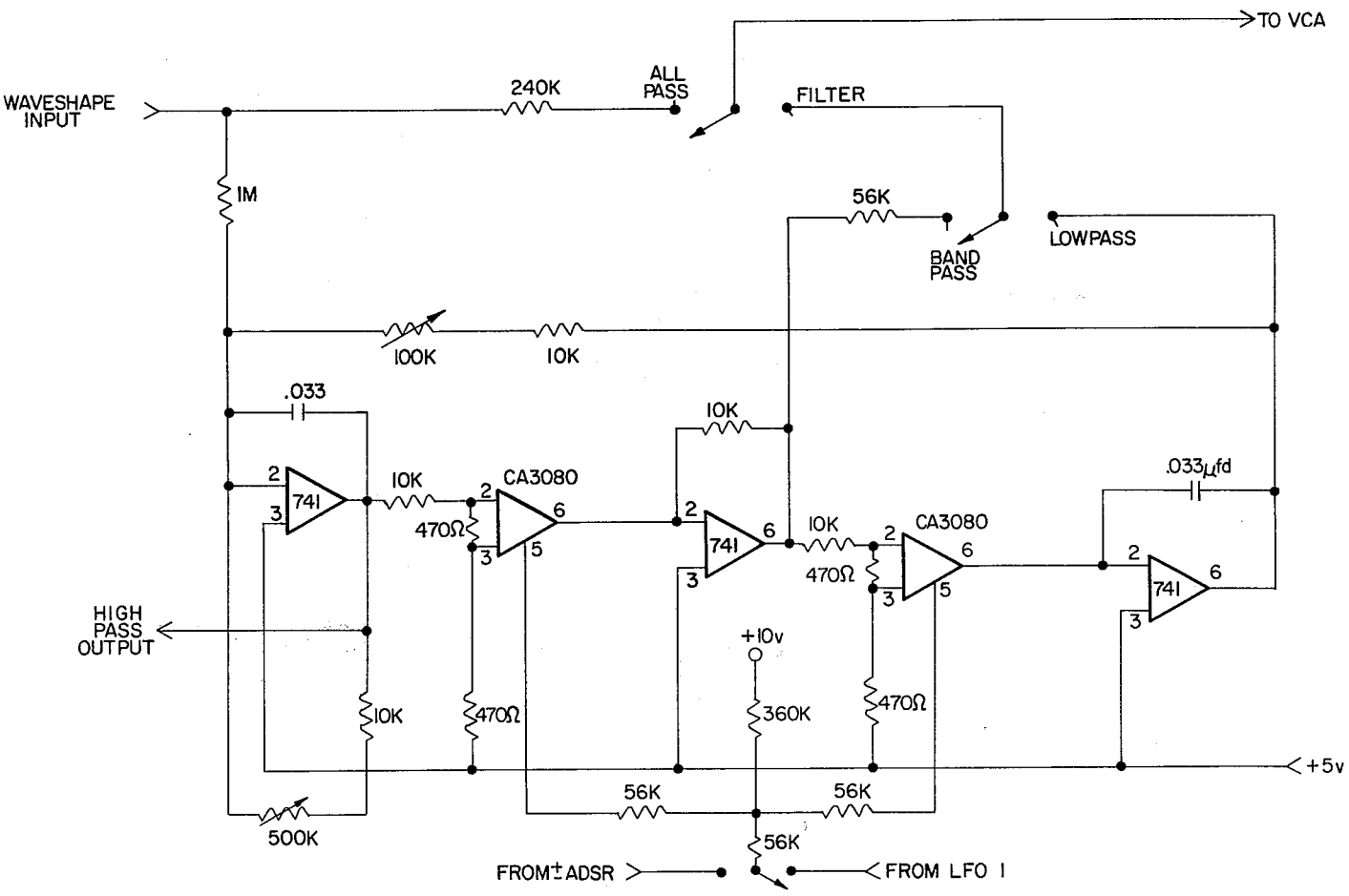
FIG. 20 is a schematic circuit diagram illustrating the practical components of a filter circuit of this invention.
Figure 22:
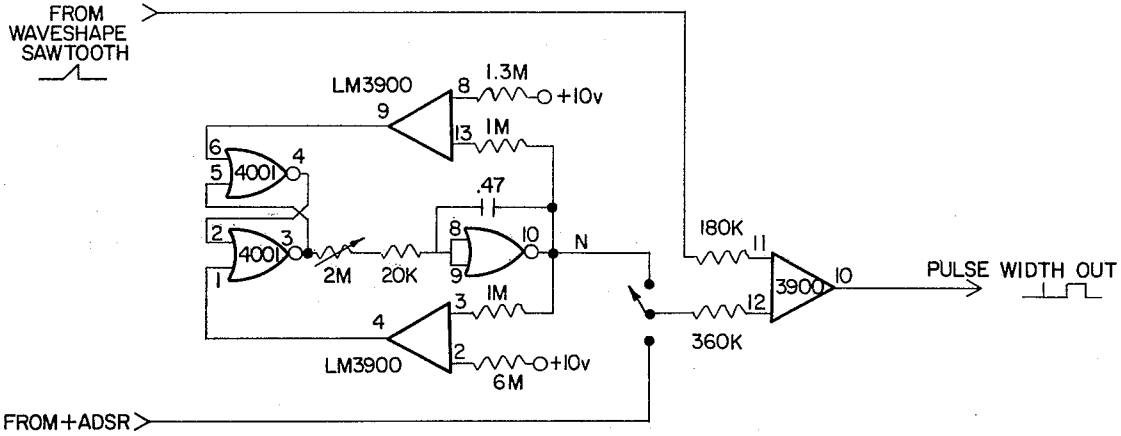
FIG. 22 is a schematic diagram illustrating practical components of a second low frequency oscillator circuit of this invention referred to in certain other figures as LF02.
Figure 21:
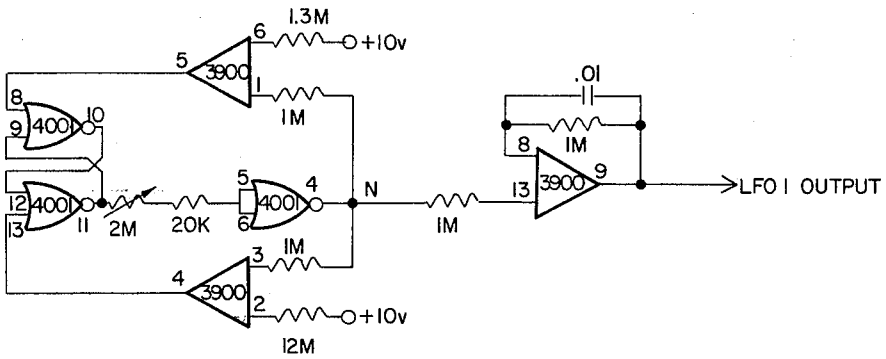
FIG. 21 is a schematic diagram illustrating the practical components of a low frequency oscillator circuit of this invention referred to in certain other figures as FL01.
Figure 23:
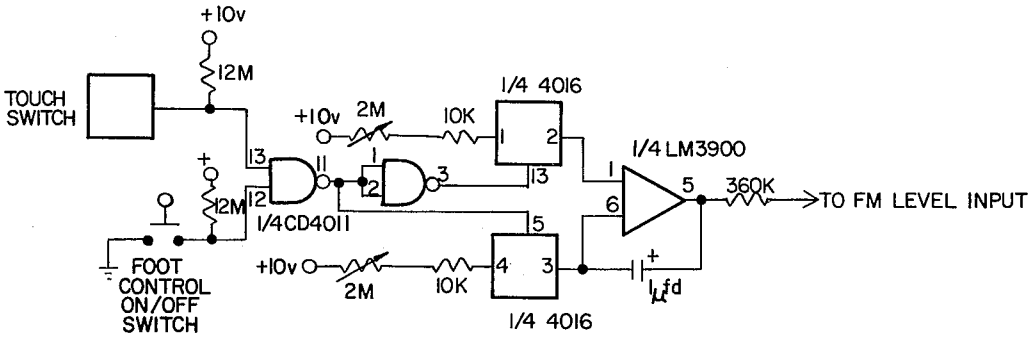
FIG. 23 is a schematic circuit diagram illustrating practical components of a pitch bend control circuit of this invention.
Figure 25:
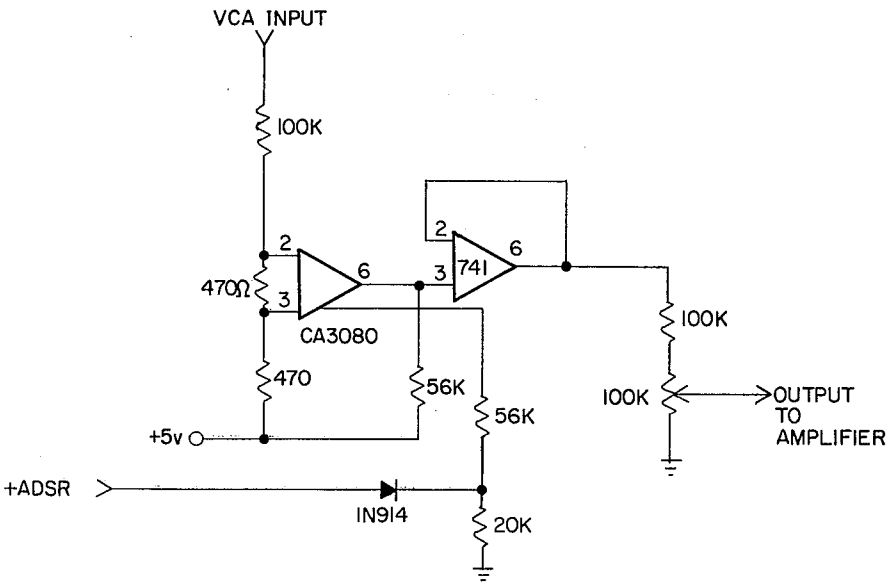
FIG. 25 is a schematic circuit diagram illustrating practical components of a volume voltage control amplifier for volume control of this invention.
Figure 24:
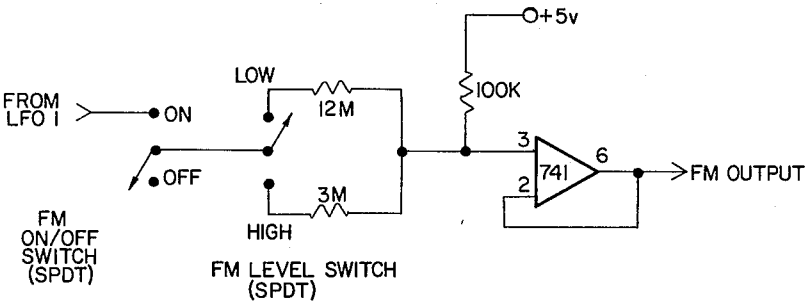
FIG. 24 is a schematic circuit diagram illustrating the practical components of a frequency modulation vibrato control circuit of this invention.

FIG. 18 illustrates a three octave switching capability which is regarded as novel for bass instruments. The midrange is normal pitch with higher and lower octaves derived digitally (see FIG. 17). FIG. 18 also illustrates a practical circuit for wave shape generation and selection. It should be understood that other equivalent circuits are within contemplation.

Although this disclosure makes reference to details of certain illustrated embodiments, and includes specific details of practical circuits, it is not intended thereby to restrict the scope of the claims which themselves recite those details regarded as essential to the invention.

I claim:

1. An electronic instrument configurated and arranged for operation by approximately the same physical motions involved in playing an electronic guitar to produce electronically generated music, comprising:

an arm with a grid of addresses corresponding to the intersection regions of a plurality of ranks of fret locations and a plurality of files of string locations, each said address being associated with touch-sensitive electronic means in circuit with pitch-control means;

a strum structure including at least one strum switch in circuit with tone-generating means; and control circuit means interconnecting said pitch control means, said tone-generating means and a power supply, wherein said touch-sensitive, electronic means associated with an address is a normally-open switching circuit including:

a conductive element carried by said arm and arranged for contact with the palm of the hand of an individual holding the arm to press the fret location of that address in the manner of a guitar player, said conductive element constituting a first contact and said fret location including a second contact at that address; and said normally-open switching circuit is adapted to close when said first and second contacts are connected through the hand of an individual holding said arm and touching said fret location at that address.

2. An electronic instrument according to claim 1 wherein said normally open switching circuit includes an electronic gate device with an input connected to a fret at said address, said fret constituting said second contact, and with an output which reflects a first potential when said circuit is in its normally open condition and a second potential when said circuit is closed, said output being connected in circuit with said pitch-control means.

3. An electronic instrument according to claim 1 wherein said strum structure includes a plurality of strum switches corresponding in number to the number of files of string locations.

4. An electronic instrument according to claim 3 wherein each said strum switch is connected in circuit with its own tone-generating means so that a plurality of separate tones may be generated simultaneously by operation of a corresponding plurality of said strum switches.

5. An electronic instrument according to claim 2 wherein said strum structure includes a conductor suspended through a structure at reference potential and adapted for movement into conductive relationship with said structure, thereby to apply said reference potential to said strum switch.

6. An electronic instrument according to claim 5 wherein said structure at reference potential includes a conductive block with a bore, and one end of said conductor is suspended through said bore such that it is normally electrically isolated therefrom but is brought into conductive relationship therewith by pressure in any direction upon said conductor.

7. An electronic instrument according to claim 6 wherein said conductor comprises a strumming element connected at one end of a strumming region in association with an electronic output and at the opposite end of said strumming region by means of a conductive spring comprising the portion of said conductor suspended through said structure at ground potential, said spring being in conductive relationship with said output.

8. An electronic instrument according to claim 1 wherein said frets are in circuit with means for muting the tone from a strum switch as controlled by contact of a first address when a second address is contacted.

9. An electronic instrument configurated and arranged for operation by approximately the same physical motions involved in playing an electric guitar to produce electronically generated music, comprising:

an arm with a grid of addresses corresponding to the intersection regions of a plurality of ranks of fret locations and a plurality of files of string locations, each said address being associated with touch-sensitive, electronic means in circuit with pitch-control means;

a strum structure including a conductor with one end suspended through a bore in a conductive block at reference potential such that it is normally electrically isolated from said block but is brought into conductive relationship therewith by pressure in any direction upon said conductor; and control circuit means interconnecting said pitch control means, said tone-generating means and a power supply.

10. An electronic instrument according to claim 9 wherein said touch-sensitive means associated with an address is a normally-open switching circuit including:

a conductive element carried by said arm and arranged for contact with the palm of the hand of an individual holding the arm to press the fret location of that address in the manner of a guitar player, said conductive element constituting a first contact and said fret location including a second contact at that address; and said normally open switching circuit is adapted to close when said first and second contacts are connected through the hand of an individual holding said arm and touching said fret location at that address.

11. An electronic instrument according to claim 10 wherein said normally open switching circuit includes an electronic gate device with an input connected to a fret at said address, said fret constituting said second contact, and with an output which reflects a first potential when said circuit is in its normally open condition and a second potential when said circuit is closed, said output being connected in circuit with said pitch-control means.

12. An electronic instrument according to claim 9 wherein said strum structure includes a plurality of strum switches corresponding in number to the number of files of string locations.

13. An electronic instrument according to claim 12 wherein each said strum switch is connected in circuit with its own tone-generating means so that a plurality of separate tones may be generated simultaneously by operation of a corresponding plurality of said strum switches.

14. An electronic instrument according to claim 9 wherein said strum structure includes a conductor suspended through a structure at reference potential and adapted for movement into conductive relationship with said structure, thereby to apply said reference potential to said strum switch.

15. An electronic instrument according to claim 9 wherein said conductor comprises a strumming element connected at one end of a strumming region in association with an electronic output and at the opposite end of said strumming region by means of a conductive spring comprising the portion of said conductor suspended through said structure at ground potential, said spring being in conductive relationship with said output.

16. An electronic instrument according to claim 9 wherein said frets are in circuit with means for muting the tone from a strum structure as controlled by contact of a first address when a second address is contacted.

* * * * *